US009991042B2

(12) United States Patent
Xu et al.

(10) Patent No.: US 9,991,042 B2
(45) Date of Patent: Jun. 5, 2018

(54) FIXING STRUCTURE FOR UPPER PRESSING BLOCKS OF STEREOSCOPIC WOUND CORE OPEN-VENTILATED DRY-TYPE TRANSFORMER

(71) Applicant: Haihong Electric Co., Ltd., Kaiping (CN)

(72) Inventors: Kaixuan Xu, Kaiping (CN); Xianqing Guo, Kaiping (CN); Qingning Liang, Kaiping (CN); Liqiong Long, Kaiping (CN)

(73) Assignee: Haihong Electric Co., Ltd., Kaiping (CN)

( * ) Notice: Subject to any disclaimer, the term of this patent is extended or adjusted under 35 U.S.C. 154(b) by 0 days. days.

(21) Appl. No.: 14/527,220

(22) Filed: Oct. 29, 2014

(65) Prior Publication Data

US 2016/0055959 A1 Feb. 25, 2016

(30) Foreign Application Priority Data

Aug. 25, 2014 (CN) ..... 2014 1 0422517

(51) Int. Cl.
*H01F 27/24* (2006.01)
*H01F 27/32* (2006.01)
(Continued)

(52) U.S. Cl.
CPC ..... *H01F 27/2823* (2013.01); *H01F 27/24* (2013.01); *H01F 27/306* (2013.01);
(Continued)

(58) Field of Classification Search
CPC ..... H01F 27/26; H01F 27/30; H01F 27/34; H01F 2027/328; H01F 27/306; H01F 27/303
(Continued)

(56) References Cited

U.S. PATENT DOCUMENTS 3,983,523 A * 9/1976 Ayers ..... H01F 27/36 336/84 R
4,404,740 A * 9/1983 Hagg ..... H01F 27/004 336/197
(Continued)

FOREIGN PATENT DOCUMENTS

CN 200976301 Y * 11/2007 ..... H01F 27/00
CN 201868202 U * 6/2011 ..... H01F 27/28
(Continued)

OTHER PUBLICATIONS

CN 200976301 Y, machine translation, Nov. 2007.*
(Continued)

*Primary Examiner* — Elvin G Enad
*Assistant Examiner* — Malcolm Barnes
(74) *Attorney, Agent, or Firm* — King & Schickli, PLLC

(57) ABSTRACT

A fixing structure for the upper pressing blocks of a stereoscopic wound core open-ventilated dry-type transformer, including three coils arranged vertically. Three coils are arranged in triangle; an insulation ring is arranged at the upper end of each of the coils; a pressing block used for pressing the corresponding coil is placed on the upper surface of each insulation ring; an upper clamp is arranged above the pressing blocks; and press rods for pressing the pressing blocks are arranged on the bottom surface of the upper clamp. According to the disclosure, the upper clamp presses the pressing blocks and then the pressing blocks 3 press the coils, so the loosening of the coils is prevented and impact resistance of the coils is ensured; moreover, the pressing blocks which press the coils do not need to be tensioned by a lower clamp through utilizing a screw, and thus, the phase-to-phase distance between three coils will not be increased and the insulation distance between the coils is not to be increased; and in addition, four pressing
(Continued)

blocks are evenly arranged on each coil, and thus, the coils bear more uniform stress, so the coils can be pressed better.

1 Claim, 5 Drawing Sheets

(51) Int. Cl.
*H01F 27/28* (2006.01)
*H01F 27/30* (2006.01)
*H01F 30/12* (2006.01)

(52) U.S. Cl.
CPC ..... *H01F 27/32* (2013.01); *H01F 27/324* (2013.01); *H01F 30/12* (2013.01)

(58) Field of Classification Search
USPC ..... 336/5, 65, 67, 192, 196, 197, 199, 210
See application file for complete search history.

(56) References Cited

U.S. PATENT DOCUMENTS 4,542,362 A * 9/1985 Beisser ..... H01F 27/306
336/198
2011/0309902 A1* 12/2011 Bonin ..... H01F 27/12
336/57

FOREIGN PATENT DOCUMENTS

CN 101630582 B * 7/2012 ..... H01F 27/32
CN 102290206 B * 11/2012 ..... H01F 27/26

OTHER PUBLICATIONS

CN 201868202 U, machine translation, Jun. 2011.*
CN 101630582 B, machine translation, Jul. 2012.*
CN 102290206 B, machine translation, Nov. 2012.*

* cited by examiner

FIXING STRUCTURE FOR UPPER PRESSING BLOCKS OF STEREOSCOPIC WOUND CORE OPEN-VENTILATED DRY-TYPE TRANSFORMER

CROSS-REFERENCE TO RELATED APPLICATIONS

This Application claims priority to Application 201410422517.X filed on Aug. 25, 2014 in China.

BACKGROUND

The present disclosure relates to the field of a transformer, in particular to a fixing structure for upper pressing blocks of a stereoscopic wound core open-ventilated dry-type transformer.

It is known to all that a stereoscopic wound core open-ventilated dry-type transformer is of non-packed structure; iron cores and coils are arranged in stereoscopic triangle; cushion blocks around are fixed directly by means of compression of a triangular frame. However, the compression method for the triangular area is especially important. Not only shall the strength of the compression force be considered so as to ensure short circuit resistance of the transformer, but also the way of compression shall be considered, so the insulation distance between the coils is not increased. At present, a relatively popular practice is that a screw is adopted in the center of the triangular area of transformer and the pressing blocks above are tensioned through lower clamp. This structure has the shortcomings that the tensioning screw is in the center of three coils so the insulation distance between the coils needs to be increased, and the insulating treatment of the tensioning screw has significant influence on the quality of the transformer. Therefore, the fixation of the pressing blocks in the triangular area of stereoscopic wound core open-ventilated transformer needs to be further optimized.

In order to solve the problems mentioned above, the present disclosure aims to provide a simple-constructed fixing structure which can fix pressing blocks in the triangular area of the transformer while the insulation distance between the coils would not be increased and ensure short circuit resistance of the transformer.

To solve the technical problems, the disclosure adopts the technical scheme:

A fixing structure for the upper pressing blocks of the stereoscopic wound core open-ventilated dry-type transformer includes three coils which are arranged vertically; three coils are arranged in triangle; an insulation ring is arranged at the upper end of each of the coils; one pressing block used for pressing the corresponding coil is placed on the upper surface of each insulation ring; an upper clamp is arranged above the pressing blocks; press rods for pressing the pressing blocks are arranged on the bottom surface of the upper clamp.

As an improvement of the technical scheme above, four pressing blocks are correspondingly arranged on each of the coils; four pressing blocks are uniformly distributed on the upper surface of the corresponding insulation ring and the included angle between any two adjacent pressing blocks is 90°.

As an improvement of the technical scheme above, each insulation ring is made of two semicircular insulation half-rings joining together. Each pressing block is pressed at the joint of the two semicircular insulation half-rings.

Preferably, the upper clamp is a hollow hexagonal framework; a pressing block fixing plate for pressing the pressing blocks below is arranged at the central position of the hexagonal framework; a transverse plate of the pressing block fixing plate arches upwards so the horizontal height of the transverse plate is higher than that of the upper end of an iron core of the corresponding coil; press rods for pressing the pressing blocks below are arranged on the lower surface of the transverse plate.

Furthermore, the length of each press rod arranged on the transverse plate is greater than that of each press rod arranged on the upper clamp.

The fixing structure has the beneficial effects that: according to the disclosure, the upper clamp presses the pressing blocks and then the pressing blocks press the coils so as to prevent the coils from loosening, thereby ensuring impact resistance of the coils; moreover, the pressing blocks which press the coils do not need to be tensioned by a lower clamp through utilizing a screw, and thus, the phase-to-phase distance between three coils will not be increased and the insulation distance between the coils is not to be increased; and in addition, four pressing blocks are evenly distributed on each coil, and thus the coils bear stress evenly, so the coils can be pressed better.

BRIEF DESCRIPTION OF DRAWINGS

Further detailed explanation of the disclosure will be made below by combining the accompanying drawings and the embodiments.

DETAILED DESCRIPTION

Figure 1:
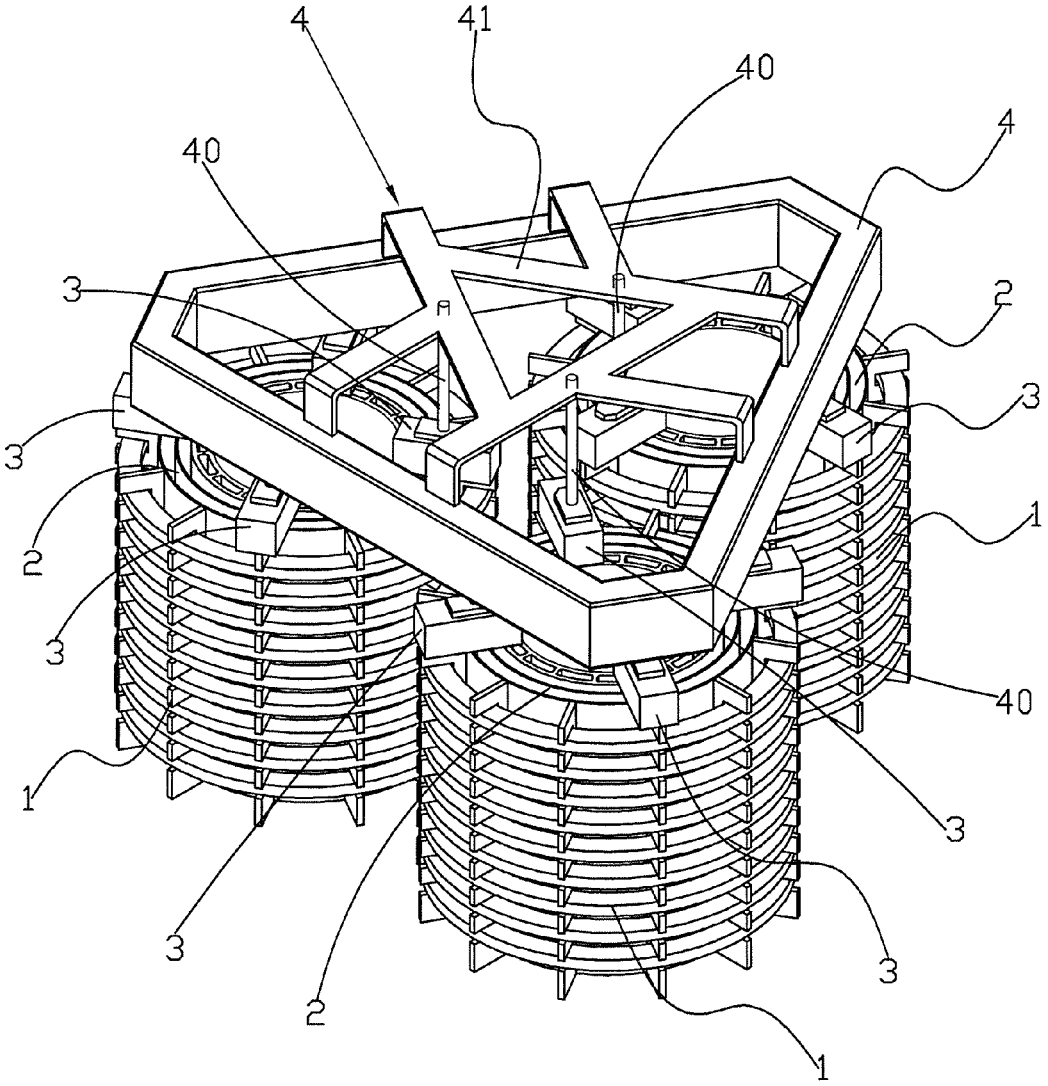
FIG. 1 is a structural diagram of the disclosure.
Figure 2:
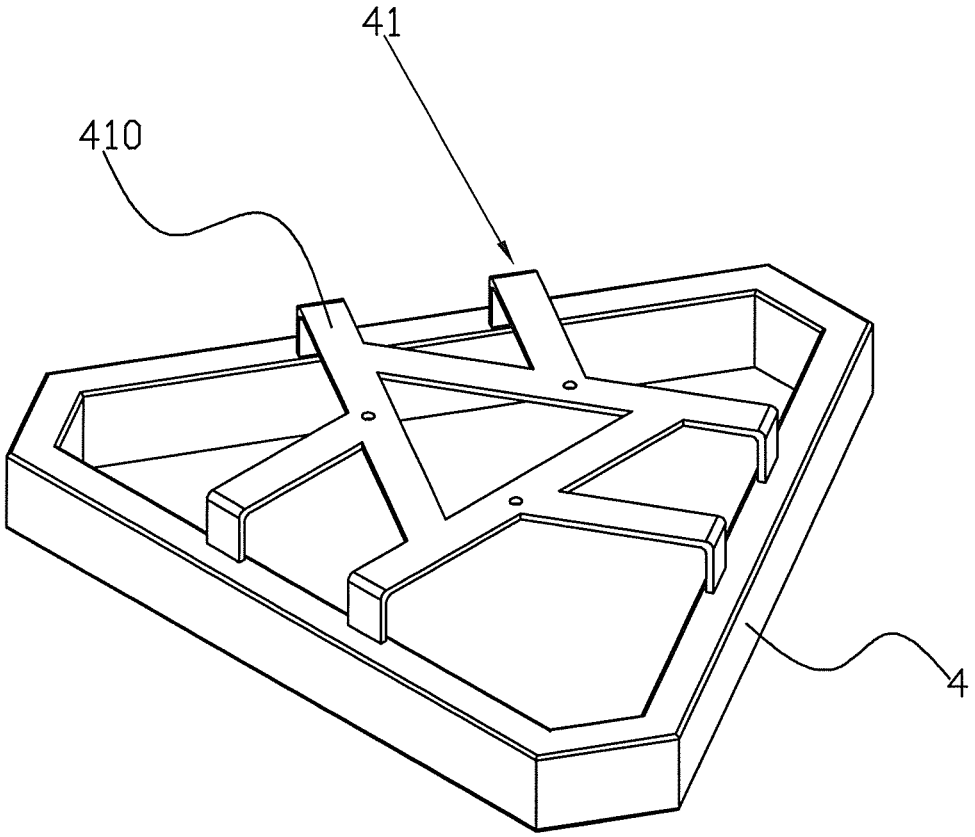
FIG. 2 is a part drawing of an upper clamp of the disclosure.
Figure 3:
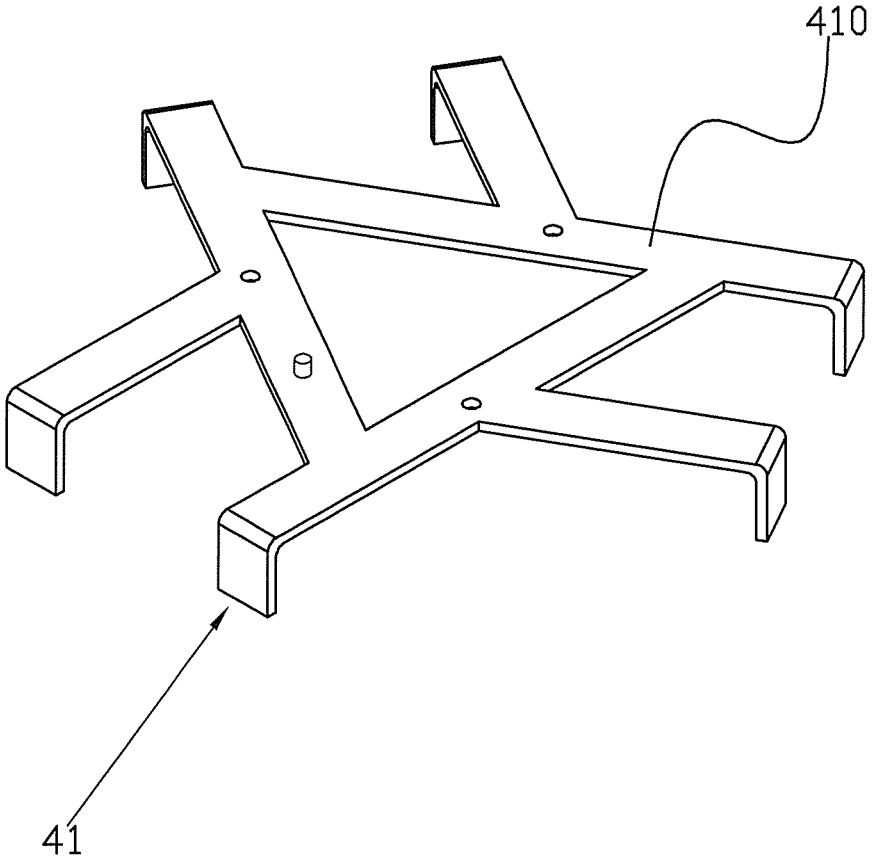
FIG. 3 is a part drawing of a pressing block fixing plate of the disclosure.

Referring to FIG. 1 to FIG. 5, a fixing structure for the upper pressing blocks of a stereoscopic wound core open-ventilated dry-type transformer includes three coils 1 which are arranged vertically. Three coils 1 are arranged in triangle, and an insulation ring 2 is arranged at the upper end of each of the coils 1. One pressing block 3 used for pressing the corresponding coil 1 is placed on the upper surface of each insulation ring 2. The insulation rings 2 are mainly used for pressing the coils 1, and as the coils 1 are stereoscopically arranged, each insulation ring 2 needs to be designed to be two halves so as to facilitate installation. In the disclosure, preferably, each insulation ring 2 is made of two semicircular insulation half-rings joining together; each pressing block 3 is pressed at the joint or the overlapped position of the corresponding two semicircular insulation half-rings. An upper clamp 4 is arranged above the pressing blocks 3. Press rods 40 for pressing the pressing blocks 3 are arranged on the bottom surface of the upper clamp 4. According to the disclosure, the upper clamp 4 presses the pressing blocks 3 and then the pressing blocks 3 press the coils 1, so the loosening of the coils 1 is prevented and impact resistance of the coils 1 is ensured. Moreover, the pressing blocks 3 which press the coils 1 do not need to be tensioned by a lower clamp through utilizing a screw, and thus, the phase-to-phase distance between three coils 1 will not be increased and the insulation distance between the coils is not to be increased.

In order to enable the pressure applied to the coils 1 by the pressing blocks 3 to be more uniform, preferably, four pressing blocks 3 are correspondingly arranged on each of the coil 1. Four pressing blocks 3 are uniformly distributed on the upper surface of the corresponding insulation ring 2, and the included angle between any two adjacent pressing blocks 3 is 90°. As four pressing blocks 3 are uniformly pressed on one coil 1, the upper end of the coil 1 bears a more uniform pressure and cannot be turned up in a certain direction, so the pressing effect of the pressing blocks 3 is ensured.

To facilitate the production, processing and installation, preferably, the upper clamp 4 is a hollow hexagonal framework, and a pressing block fixing plate 41 for pressing the pressing blocks 3 below is arranged at the central position of the hexagonal framework. In the disclosure, the pressing block fixing plate 41 can be fixed on the upper clamp 4 by welding or bolt connection. A transverse plate 410 of the pressing block fixing plate 41 arches upwards so the horizontal height of the transverse plate 410 is higher than that of the upper end of an iron core of coil. Press rods 40 for pressing the pressing blocks 3 below are arranged on the lower surface of the transverse plate 410. According to the size of the transformer, the above-mentioned pressing block fixing plate 41 can be formed by bending and welding steel plates and also can be formed by welding angle steels. To ensure the pressing effect of the pressing block fixing plate 41 on the pressing blocks 3 below, preferably, the length of each press rod arranged on the transverse plate 410 is greater than the length of each press rod arranged on the upper clamp 4. In the disclosure, the size of each above-mentioned press rod 40 is determined according to the actual requirements. According to actual situation, the press rods 40 with comparatively larger diameters may be selected, so the pressing blocks 3 can be better pressed and the pressing effect of the pressing blocks 3 on the coils 1 is ensured.

As a regular triangular region is formed by surrounding of three coils 1, a regular triangle is also formed at the central area of the transverse plate 410 of the pressing block fixing plate 41. Three sides of the regular triangle are respectively provided with press rods 40 for pressing the pressing blocks 3 below. Three pressing blocks 3 below three sides of the regular triangle are respectively pressed on three coils 1.

Figure 4:
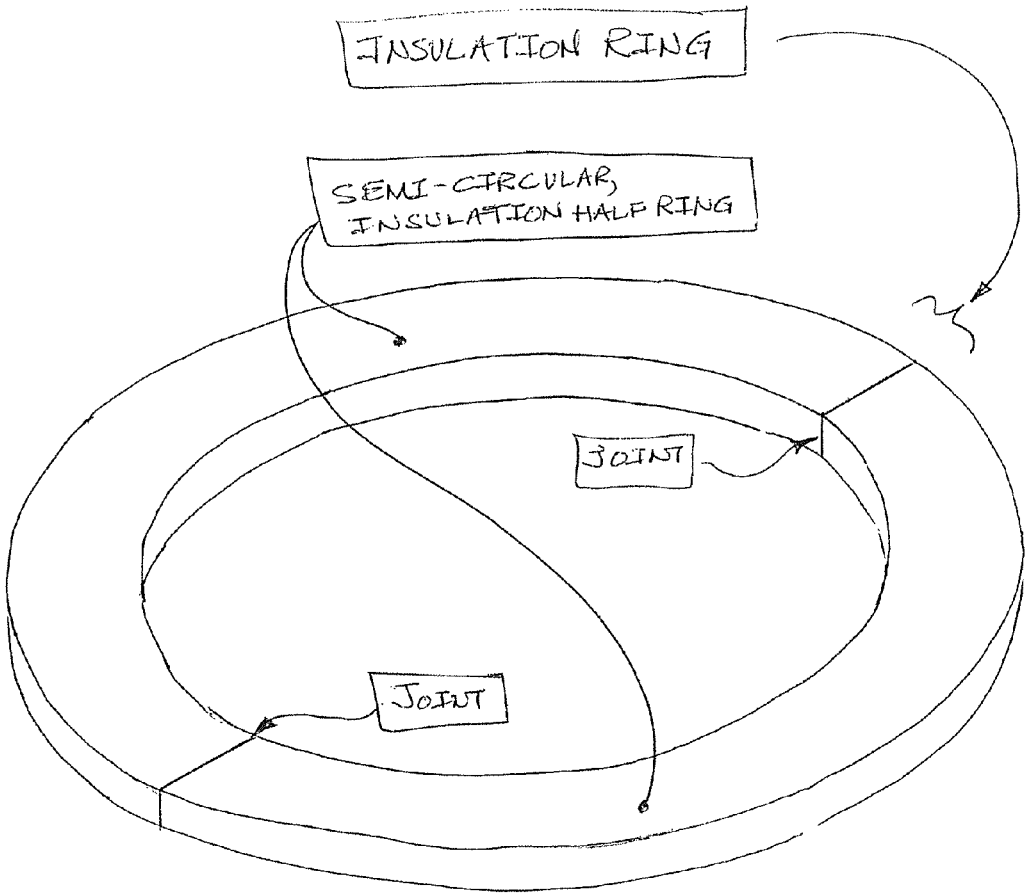
FIG. 4 shows two semicircular insulation half-rings joined together.

FIG. 4 shows two semicircular insulation half-rings joined together.

Figure 5:
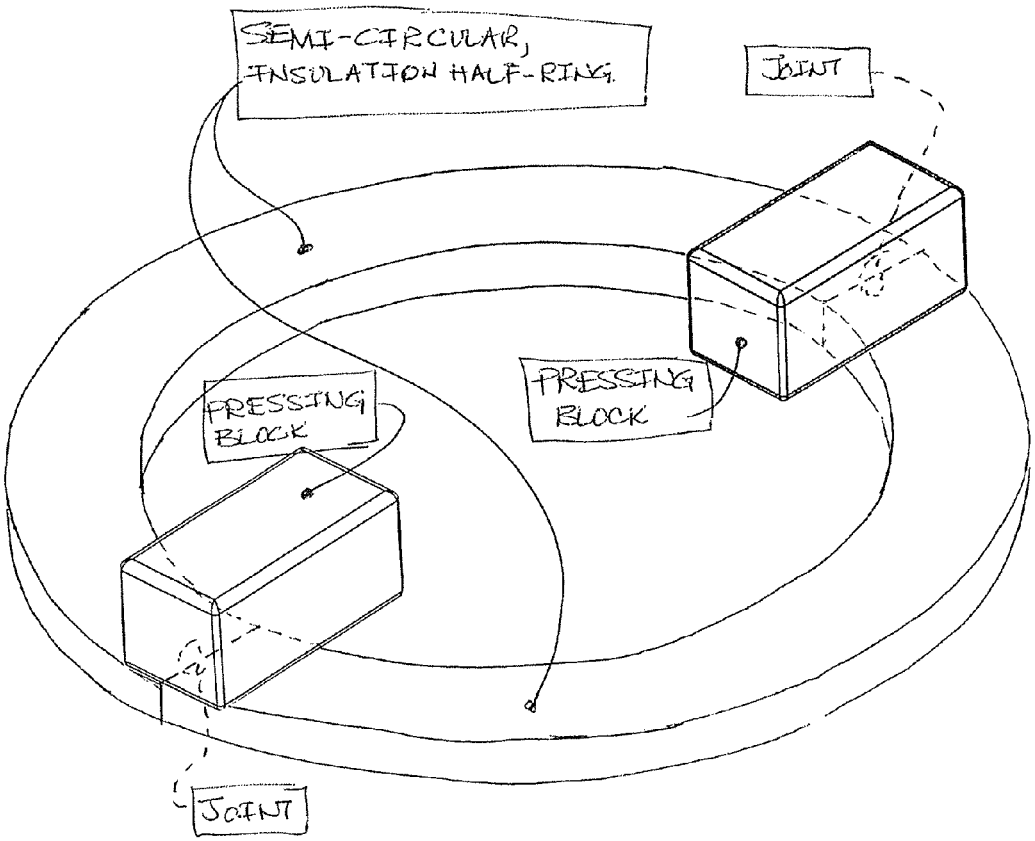
FIG. 5 shows two semicircular insulation half-rings joined together, each pressing block pressed at the joint of the two insulation half-rings.

FIG. 5 shows two semicircular insulation half-rings joined together, each pressing block 3 pressed at the joint of the two insulation half-rings.

The above is only an exemplary embodiment of the disclosure. All technical schemes for accomplishment of purposes of the disclosure by the basically same means shall belong to the scope of protection afforded by the disclosure.

What is claimed is:

1. A fixing structure for upper pressing blocks of a stereoscopic wound core open-ventilated dry-type transformer, comprising:

three coils which are arranged vertically, the three coils are arranged in triangle and an insulation ring is arranged at the upper end of each of the coils;

one pressing block used for pressing the corresponding coil is placed on the upper surface of each insulation ring;

an upper clamp is arranged above the pressing blocks;

press rods for pressing the pressing blocks are arranged on the bottom surface of the upper clamp, wherein four pressing blocks are correspondingly arranged on each of the coils; four pressing blocks are uniformly distributed on the upper surface of the corresponding insulation ring and the included angle between any two adjacent pressing blocks is 90°, wherein the upper clamp is a hollow hexagonal framework;

a pressing block fixing plate for pressing the pressing blocks below is arranged at the central position of the hexagonal framework;

a transverse plate of the pressing block fixing plate arches upwards so the horizontal height of the transverse plate is higher than that of the upper end of an iron core of the corresponding coil;

press rods for pressing the pressing blocks below are arranged on the lower surface of the transverse plate, wherein the length of each press rod arranged on the transverse plate is greater than that of each press rod arranged on the upper clamp, wherein the pressing blocks which press the coils are not to be tensioned by a lower clamp through utilizing a screw, and thus, a phase-to-phase distance between the three coils will not be increased and the insulation distance between the coils is not to be increased, and each insulation ring is made of two semicircular insulation half-rings joining together; each pressing block is pressed at the joint of the two semicircular insulation half-rings;

the pressing block fixing plate (41) can independently compress the pressing blocks (3) by press rods (40).

* * * * *